United States Patent [19]

Humpert et al.

[11] Patent Number: 5,014,749

[45] Date of Patent: May 14, 1991

[54] MIXING VALVE WITH DECORATIVE FAUCET

[75] Inventors: Jurgen Humpert, Hemer; Manfred Pawelzik, Soest, both of Fed. Rep. of Germany

[73] Assignee: Friedrich Grohe Armaturenfabrik GmbH & Co., Hemer, Fed. Rep. of Germany

[21] Appl. No.: 491,667

[22] Filed: Mar. 9, 1990

[30] Foreign Application Priority Data

Mar. 10, 1989 [DE] Fed. Rep. of Germany ..... 3907892

[51] Int. Cl.[5] ..... E03C 1/04

[52] U.S. Cl. ..... 137/801; 4/192

[58] Field of Search ..... 4/192; 137/801

[56] References Cited

U.S. PATENT DOCUMENTS 3,911,947 10/1975 Boxall ..... 137/505.42 X
4,226,730 10/1980 Hunter ..... 166/274

FOREIGN PATENT DOCUMENTS 0012890 1/1983 European Pat. Off. .
1732891 10/1956 Fed. Rep. of Germany .
2314853 1/1977 Fed. Rep. of Germany .
3038452 9/1982 Fed. Rep. of Germany .

*Primary Examiner*—Gerald A. Michalsky
*Attorney, Agent, or Firm*—Herbert Dubno; Andrew Wilford

[57] ABSTRACT

A valve assembly comprises a valve body having an nonplanar outer surface and formed with a threaded seat opening at the surface and with a passage opening into the seat. A valve in the body supplies water through the passage to the seat and a metallic tube having a threaded inner end engaged tightly in the seat forms an extension of the passage. A decorative sleeve engaged concentrically around the tube has an inner end shaped to fit flush against the body outer surface. A retaining device is engaged between the outer end of the tube and the outer end of the sleeve for pressing the inner end of the sleeve against the body outer surface. The retainer for the tube includes a snap ring fitted to the outer end of the tube and an elastomeric washer engaged between the snap ring and the tube outer end.

16 Claims, 2 Drawing Sheets

MIXING VALVE WITH DECORATIVE FAUCET

FIELD OF THE INVENTION

The present invention relates to a valve assembly. More particularly this invention concerns such a valve provided with a faucet.

BACKGROUND OF THE INVENTION

A standard faucet comprises a complicated housing body provided internally with a valve that is connected on the one side to incoming hot- and cold-water lines and on the other side to an outgoing flow passage. A faucet projecting laterally from and carried on the body receives water from the flow passage.

As described in U.S. Pat. No. 4,698,858 the faucet is integrally cast with the valve body. Thus this combined valve/faucet structure is a complicated element that adds considerably to the cost of the valve assembly.

In European patent 12,890 filed by K. Grohe based on a German priority of 06 Dec. 1978 the faucet is a tube projecting from the valve body and acting as a holder and guide for the outer end of a hose. Thus when the hose is retracted into the assembly its outer end acts like a standard faucet, but when pulled out it can be used as a sprayer or hand shower. Such an arrangement is also fairly complex and quite costly.

The faucet of U.S. Pat. No. 3,911,946 is formed by an outer decorative cast element and an inner cast element, the inner element actually serving to conduct the water. Such a device is, once again, quite expensive to manufacture.

The known arrangements all suffer from the further problem that they cannot be repaired easily, as the entire cast assembly must be replaced so that it is usually cheaper to put in a new valve assembly. Furthermore, the entire valve assembly conforms to a predetermined design and in no way can, for instance, its color other design consideration be changed without once again selecting an entirely new unit.

OBJECTS OF THE INVENTION

It is therefore an object of the present invention to provide an improved valve assembly.

Another object is the provision of such an improved valve assembly which overcomes the above-given disadvantages, that is which is of inexpensive construction but which can nonetheless be adapted cheaply to different designs.

SUMMARY OF THE INVENTION

A valve assembly according to this invention comprises a valve body having an nonplanar outer surface and formed with a threaded seat opening at the surface and with a passage opening into the seat. A valve in the body supplies water through the passage to the seat and a metallic tube having a threaded inner end engaged tightly in the seat forms an extension of the passage. A decorative sleeve engaged concentrically around the tube has an inner end shaped to fit flush against the body outer surface. A retaining device is engaged between the outer end of the tube and the outer end of the sleeve for pressing the inner end of the sleeve against the body outer surface.

Thus with this arrangement the main flow-conducting and -controlling elements of the valve are all made of simple machined parts. The sleeve, which must make a complicated transition between the faucet which typically extends at an acute angle to the valve body, serves a primarily decorative purpose, not a flow-conducting or structural one, and can be made fairly cheaply of a synthetic resin. This also makes it possible to provide sleeves in different finishes, chromium-plated or variously colored, so that at very low cost the overall appearance of the valve can be changed dramatically.

According to another feature of this invention the retainer for the tube includes a snap ring fitted to the outer end of the tube and a compressible element engaged between the snap ring and the tube outer end. This element is an elastomeric washer. This makes it fairly easy to mount the sleeve solidly on the tube, with the sleeve inner end pressed elastically against the surface of the valve body. Furthermore, the sleeve is formed with a plurality of radially inwardly projecting centering ribs braced on the tube. The sleeve is made of a synthetic resin and the tube and housing are made of brass. Thus the valve body can be made cheaply by machining a piece of rod stock, and the tube is a similarly machined piece of tubing.

The outer surface of the sleeve according to the invention is substantially cylindrical and centered on a body axis and the tube is centered on and extends along a faucet axis forming an acute angle with the body axis. The inner end of the sleeve is formed with a drain notch.

The valve assembly in accordance with this invention further has an outer end piece fitted to the outer ends of the sleeve and tube. Respective inner and outer seals are provided between the inner and outer ends of the tube and the body and end piece, respectively. The end piece and outer sleeve end are together formed with a releasable bayonet coupling constituted by inwardly projecting tabs on the sleeve outer end and outwardly open J-shaped slots on the end piece. The end piece has a recess fitted over the outer tube end and to a bushing fits in the recess around the outer tube end. Thus the end piece can be adapted, by the provision of differently sized bushings, to fit different tubes.

DESCRIPTION OF THE DRAWING

The above and other objects, features, and advantages will become more readily apparent from the following, reference being made to the accompanying drawing in which.

SPECIFIC DESCRIPTION

Figure 1:
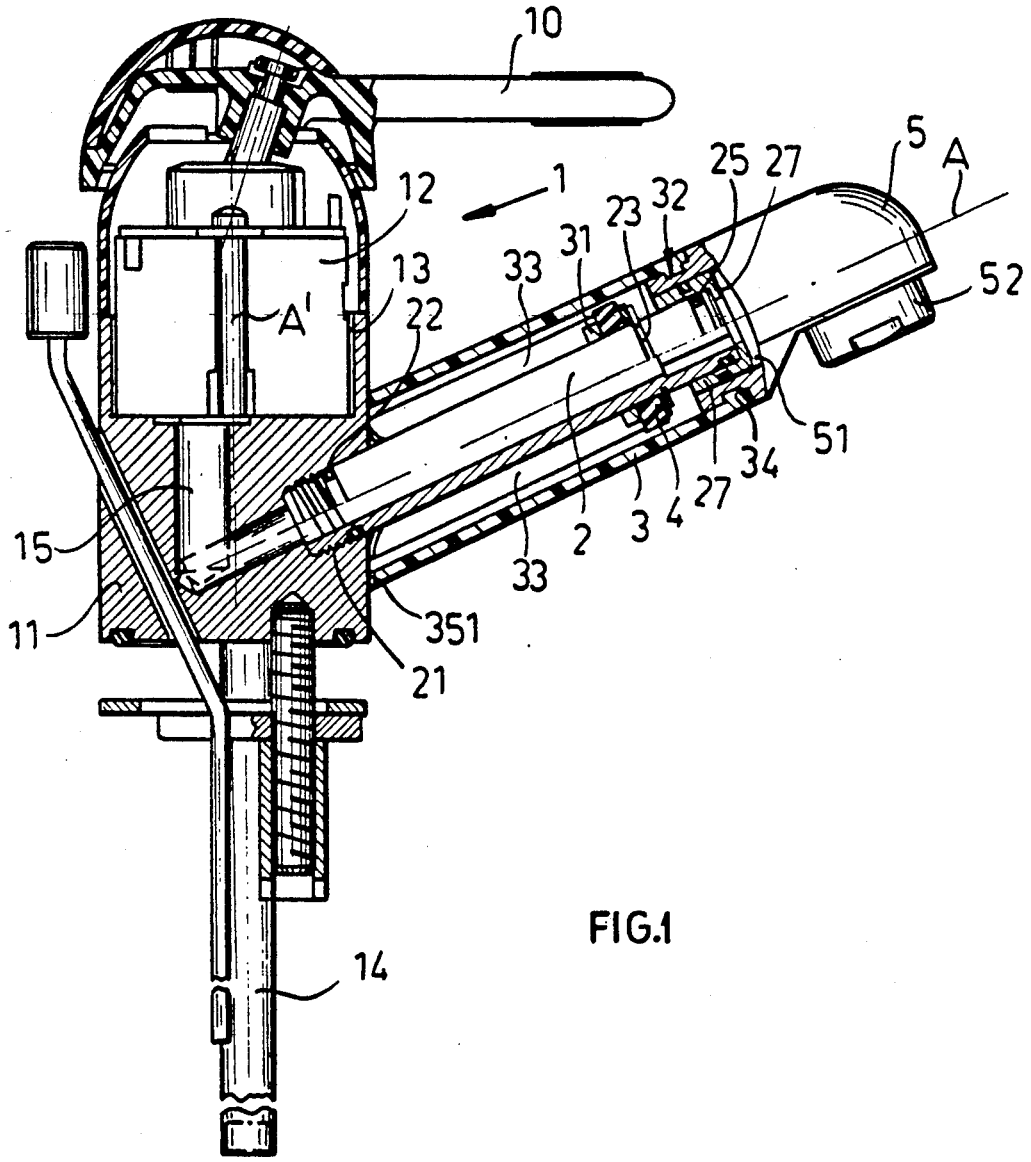
FIG. 1 is a vertical axial section through the valve assembly according to this invention.
Figure 2:
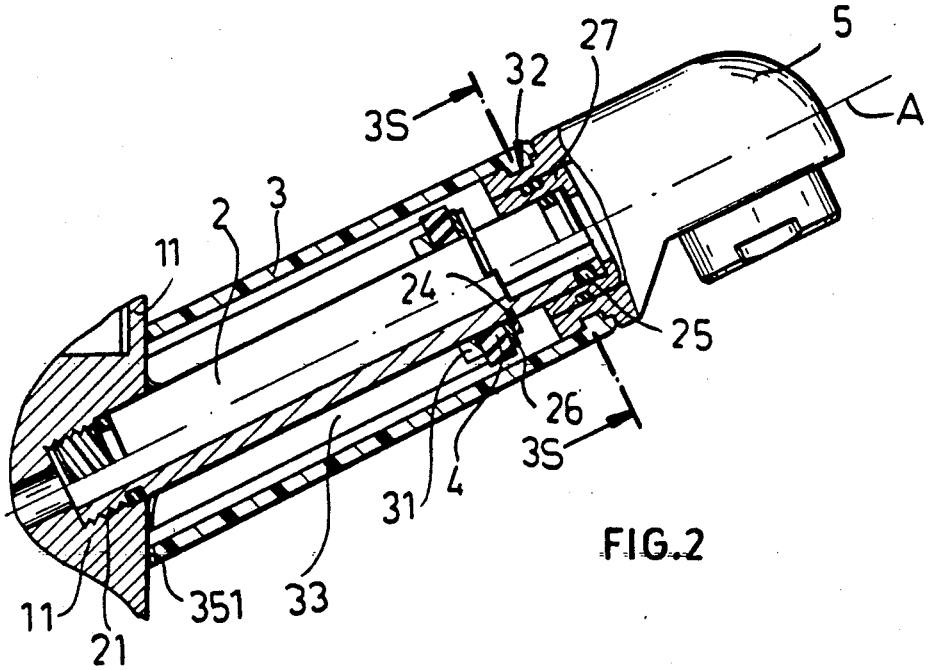
FIG. 2 is a larger-scale view of a detail of FIG. 1.

As seen in FIG. 1 a valve assembly 1 has a basically cylindrical brass body 11 centered on an upright axis A' and having a faucet formed by a brass tube 2, an output end piece 5, and a decorative cover sleeve 3. This assembly 1 is adapted to be mounted on a deck adjacent a sink and is provided with supply lines 14 that project down through a single hole in the deck. The housing 11 is formed of a machined, that is not cast, piece of metal provided with a mixing valve 12 sitting in a recess 13 and operated by a single lever 10 to supply water of the desired temperature to a feed passage 15 connected to the faucet 2, 3, 5.

The tube 2 extends along a faucet axis A and has an inner end 21 that is threaded and screwed into a complementary recess or seat machined into the body 11 and communicating with the passage 15. The axis A extends at an acute angle of about 60° to the axis A'. Slightly inward of its outer (right-hand in the drawing) end the tube 2 is formed with a peripheral groove 23 into which fits a snap ring 24.

The cover sleeve 3 is made of a synthetic resin so that it can be given a fairly complex shape. This sleeve 3 has an inner end 35 shaped to fit snugly against the cylindrical outer surface of the body 11 when the sleeve 3 is centered on the axis A and is formed internally with a plurality of axially extending, angularly equispaced, and radially inwardly projecting ribs 33 that rest on the outer surface of the tube 2. A ring 31 centered on the axis A is formed at the outer ends of the ribs 33 and lies, when the sleeve 3 is installed as illustrated on the tube 2 with the surface 35 flush against the body 11, a short distance offset from the ring 24. An elastomeric ring 4 is engaged between this integral ring 31 and the snap ring 24 to press the sleeve 3 snugly in place against the body 11. A small notch 351 is formed at the lowermost point on the inner end 35 to allow any liquid or condensation in the structure to drain out.

Figure 3:
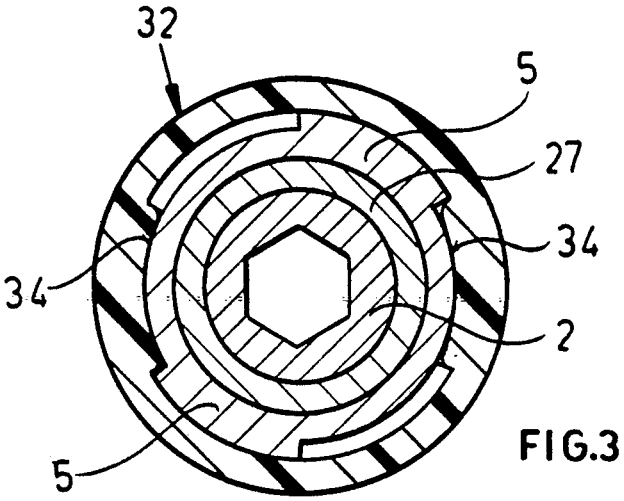
FIG. 3 is a section taken along line 3S—3S of FIG. 2.
Figure 4:
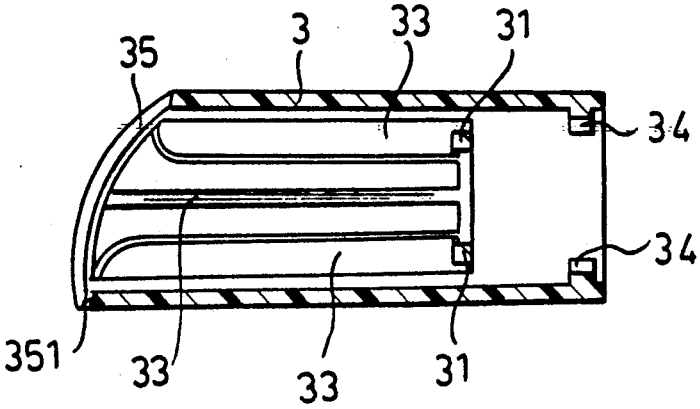
FIG. 4 is an axial section through the decorative faucet cover sleeve according to the invention.

The outer end of the tube 2 fits tightly with a seal 25 in a bushing 27 itself fitted in a bore 51 formed in the inner end of the end piece 5 which itself carries a conventional aerator 52. Thus a watertight seal and a washer 26 are made between the tube 2 and the end piece 5, and this end piece 5 can be adapted to tubes of different sizes by the use of differently sized bushings 27. The outer end of the sleeve 3 is formed as best seen in FIGS. 3 and 4 with radially inwardly projecting lugs 34 that fit in J-section slots 32 formed in the end piece 5 for a bayonet joint. Thus the end piece 5 is mounted on the structure by fitting it over the tube 2 and inside the sleeve 3, then rotating it slightly to lock it in place.

The body 1 can be made simply by machining and the tube 2 can similarly be produced cheaply. The more complexly formed sleeve 3 has no structural role so that it can be cast of a light synthetic resin. In fact the sleeve 3 can be made so cheaply that the supplier can stock a variety of different sleeves in different colors to accommodate different styles. In addition by simply changing the length of the sleeve 2 and tube 2 it is possible to vary substantially the appearance of the assembly 1.

We claim:

1. A valve assembly comprising:

a valve body having an nonplanar outer surface and formed with a threaded seat opening at the surface and with a passage opening into the seat;

valve means in the body for supplying water through the passage to the seat;

a metallic tube having a threaded inner end engaged tightly in the seat so as to form an extension of the passage and having an outer end;

a decorative sleeve engaged concentrically around the tube and having an inner end shaped to fit flush against the body outer surface and an outer end; and retaining means engaged between the outer end of the tube and the sleeve for pressing the inner end of the sleeve against the body outer surface.

2. The valve assembly defined in claim 1 wherein the retaining means includes a snap ring fitted to the outer end of the tube, and a compressible element engaged between the snap ring and the tube outer end.

3. The valve assembly defined in claim 2 wherein the compressible element is an elastomeric washer.

4. The valve assembly defined in claim 1 wherein the sleeve is formed with a plurality of radially inwardly projecting centering ribs braced on the tube.

5. The valve assembly defined in claim 4 wherein the sleeve is made of a synthetic resin.

6. The valve assembly defined in claim 1 wherein the outer surface is substantially cylindrical and centered on a body axis, the tube being centered on and extending along a faucet axis forming an acute angle with the body axis.

7. The valve assembly defined in claim 1 wherein the inner end of the sleeve is formed with a drain notch.

8. The valve assembly defined in claim 1, further comprising:

an outer end piece fitted to the outer ends of the sleeve and tube.

9. The valve assembly defined in claim 8, further comprising respective inner and outer seals between the inner and outer ends of the tube and the body and end piece, respectively.

10. The valve assembly defined in claim 8 wherein the end piece and outer sleeve end are together formed with a releasable bayonet coupling.

11. The valve assembly defined in claim 10 wherein the coupling is constituted by inwardly projecting tabs on the sleeve outer end and outwardly open J-shaped slots on the end piece.

12. The valve assembly defined in claim 8 wherein the end piece has a recess fitted over the outer tube end.

13. The valve assembly defined in claim 12 wherein the end piece includes a bushing fitting in the recess around the outer tube end.

14. The valve assembly defined in claim 1 wherein the body is basically cylindrical and is formed with a seat receiving the valve means.

15. The valve assembly defined in claim 1 wherein the body and tube are made of brass.

16. A valve assembly comprising:

a valve body having a substantially cylindrical outer surface centered on a body axis and formed with a threaded seat opening at the surface and centered on a faucet axis forming with the body axis an acute angle and with a passage opening into the seat, the outer surface being smooth and uninterrupted except at the seat;

valve means in the body for supplying water through the passage to the seat;

a cylindrical metallic tube having threaded inner end engaged tightly in the seat so as to form an extension of the passage, having an outer end, and centered on the faucet axis;

a decorative sleeve engaged concentrically around the tube and formed with an inner end shaped to fit flush against the body outer surface, an outer end spaced along the faucet axis from the inner end, internal ribs braced radially inwardly against the tube;

retaining means engaged between the outer end of the tube and the sleeve for pressing the inner end of the sleeve against the body outer surface;

an end piece having an upstream side fitted around the outer tube end and within the outer sleeve end; and a releasable coupling between the outer tube end and the upstream side of the end piece.

* * * * *